United States Patent [19]

Abrahamson et al.

[11] Patent Number: 4,705,124

[45] Date of Patent: Nov. 10, 1987

[54] CUTTING ELEMENT WITH WEAR RESISTANT CROWN

[75] Inventors: Gerald R. Abrahamson, White Bear Lake, Minn.; Ernest J. Duwell, Hudson, Wis.

[73] Assignee: Minnesota Mining and Manufacturing Company, St. Paul, Minn.

[21] Appl. No.: 899,529

[22] Filed: Aug. 22, 1986

[51] Int. Cl.[4] ..... B21K 5/02; C04B 35/56; E21B 10/58

[52] U.S. Cl. ..... 175/410; 51/309; 76/108 A; 76/DIG. 11

[58] Field of Search ..... 175/410, 409, 374; 76/108 A, 108 R, DIG. 11; 51/309; 420/430; 501/87

[56] References Cited

U.S. PATENT DOCUMENTS

| | | | |
|---|---|---|---|
| 2,108,797 | 2/1938 | Comstock | 76/DIG. 11 |
| 2,842,342 | 7/1958 | Haglund | 175/410 |
| 4,109,737 | 8/1978 | Bovenkerk | 175/410 X |
| 4,168,923 | 9/1979 | Vezirian | 175/410 X |
| 4,211,508 | 7/1980 | Dill et al. | 175/410 X |
| 4,359,335 | 11/1982 | Garner | 175/410 X |
| 4,372,404 | 2/1983 | Drake | 175/410 X |

*Primary Examiner*—Stephen J. Novosad

*Attorney, Agent, or Firm*—Donald M. Sell; James A. Smith; William L. Huebsch

[57] ABSTRACT

A cutting element adapted to be used in a rotary drill bit is made by positioning in an appropriately shaped die cavity a quantity of a mixture of tungsten carbide and 4 to 11 percent cobalt in the shape of a crown for defining an outer surface for the tip portion of the cutting element using a pressure of less than about 600 pounds per square inch; positioning in the cavity a quantity of a mixture of tungsten carbide and 12 to 17 percent cobalt sufficient to form almost all of a base portion and at least an inner part of the tip portion for the cutting element; pressing the two quantities of the mixtures together and into the die at pressures in the range of about 10 to 15 tons per square inch; and sintering the pressed insert to form the cutting element.

6 Claims, 6 Drawing Figures

CUTTING ELEMENT WITH WEAR RESISTANT CROWN

TECHNICAL FIELD

The present invention relates to cutting elements or inserts for use in rotary drill bits adapted to bore holes in rock, and to methods for forming such cutting elements.

BACKGROUND ART

Cutting elements or inserts for use in rotary drill bits adapted to bore holes in rock are conventionally made entirely of a sintered mixture of tungsten carbide with about 15 to 17 percent cobalt. Such cutting elements are tough and fracture resistant (since fracturing of the cutting elements during the drilling process can not be tolerated) but are not as wear resistant as is desired. It is known that a sintered mixture of tungsten carbide and about 9 to 11 percent cobalt has significantly greater wear resistance than that containing cobalt in the 15 to 17 percent range, however, such wear resistant tungsten carbide is too prone to fracture to be used to form the entire cutting element. Thus, as is described in U.S. Pat. No. 4,359,335, attempts have been made to attach wear pads of such wear resistant tungsten carbide on bodies of such tough tungsten carbide to provide the advantage of both in one cutting element. As described in U.S. Pat. No. 4,359,335, this has been done by first forming the wear pad by pressing a mixture of tungsten carbide with about 9 to 11 percent cobalt in a first die cavity at pressures of about fifteen tons per square inch, positioning that pressed, unsintered wear pad in a second die cavity, positioning a second mixture of tungsten carbide and about 15 to 16 percent cobalt in the second die over the pad, pressing the second mixture into the die at a pressure of about 15 tons per inch, and then sintering the combination to form the cutting element or insert.

Our experience with this method, however, has been that while it may adequately bond small wear pads on surfaces of tip portions of cutting elements that project from sockets in a rotary drill bit in which base portions of the cutting elements are received, the portions of the tougher tungsten carbide material around the pads will contact rock being cut or crushed and will wear away rapidly when compared to the wear pads so that support for the wear pads is lost and they break away.

When we have attempted to form tip portions for cutting elements that are completely or almost completely covered or crowned by the wear resistant tungsten carbide material using the method described in U.S. Pat. No. 4,359,335, voids have been formed at the interface between the wear resistant crown and the underlying base portion of the tough tungsten carbide material during the sintering process, and the crown has had a strong tendency to crack off during use so that the cutting element is unacceptable.

BRIEF DESCRIPTION

The present invention provides a method for making a cutting element with a body of tough tungsten carbide material and a crown of wear resistant tungsten carbide material, which cutting element has both more wear resistance at its end portion and toughness than a cutting element made only of the tough tungsten carbide material.

According to the present invention there is provided a method for forming a cutting element having a base portion adapted to be inserted in a socket in a rotary drill bit and a tip portion adapted to project from the socket. The method comprises the steps of (1) mixing a crown mixture of tungsten carbide powder and cobalt powder with the cobalt powder being in the range of four to eleven percent (preferably nine to eleven percent) of the crown mixture; (2) mixing a core mixture of tungsten carbide powder and cobalt powder with the cobalt powder being in the range of about twelve to seventeen percent (preferably fifteen to seventeen percent) of the core mixture; (3) providing a die having a cavity approximately the shape of the cutting element to be formed; (4) positioning in the cavity a quantity of the crown mixture in the shape of a crown defining at least the majority of the outer surface for the tip portion of the cutting element using a pressure of less than about 600 pounds per square inch; (5) positioning in the cavity a quantity of the core mixture sufficient to form almost all of the base portion and at least an inner part of the tip portion of the cutting element; (6) pressing the two quantities of the crown and core mixtures together and into the die at pressures in the range of about ten to fifteen tons per square inch; and (7) sintering the pressed insert (e.g., for about sixty minutes at about fourteen hundred degrees Centigrade) to form the cutting element.

The interfaces between the inner parts of the tips and the crowns of cutting elements made by this method have been found to be free of voids and are visually irregular when viewed at a magnification of about 65 times, which irregularity apparently helps provide the strong attachment between the inner parts and the crowns evidenced by cutting elements according to the present invention.

Also, the tungsten carbide powder in the crown mixture preferably has a grain size of under about six microns (preferably about one to one and one-half microns) which adds to the wear resistance of the crown, and the tungsten carbide powder in the core mixture preferably has a grain size in the range of five to ten microns which adds to the toughness of the base portion and the inner part of the tip.

Preferably the crown has a maximum thickness measured axially of the base portion and tip portion that is about fifty percent of the axial height of tip portion so that only the material forming the crown will engage rock being cut or crushed until the tip portion is sufficiently worn away that the cutting element is unserviceable.

BRIEF DESCRIPTION OF THE DRAWING

The present invention will be further described with reference to the accompanying drawing wherein like numbers refer to like parts in the several views, and wherein.

DETAILED DESCRIPTION

Figure 1:
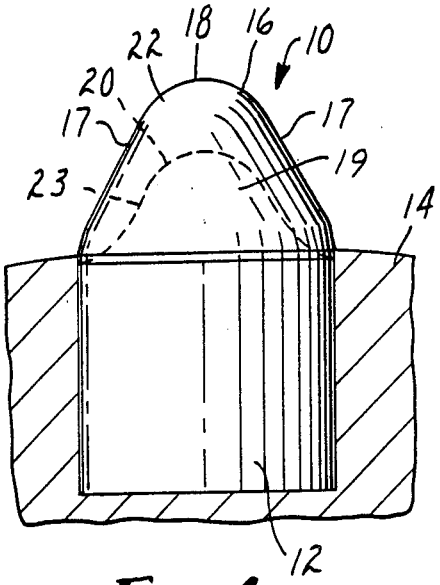
FIG. 1 is a vertical side view of a cutting element according to the present invention shown mounted in a fragment of a rotary drill bit.
Figure 2:
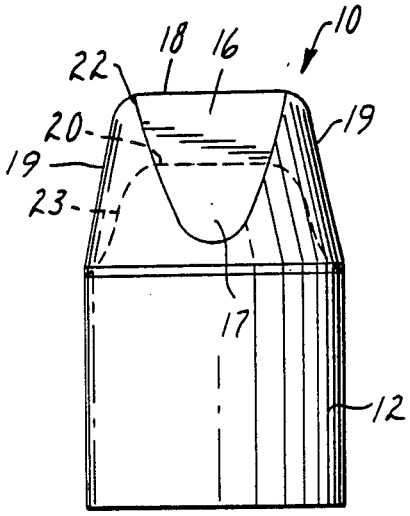
FIG. 2 is a vertical front view of the cutting element shown in FIG. 1.

Referring now to FIGS. 1 and 2 there is shown a cutting element according to the present invention generally designated by the reference numeral 10.

The cutting element 10 includes a cylindrical base portion 12 adapted to be inserted in a socket in a rotary drill bit 14, and a tip portion 16 adapted to project from the socket, which tip portion 16 has a generally conical end surface portion 19 disposed at about a 35 degree angle with respect to the axis of the cutting element 10, planar front and rear surface portions 17 forming an included angle of about 70 degrees, and an arcuate distal end surface portion 18 (e.g., 0.06 inch radius) joining the front end rear surface portions 17. The cutting element 10 comprises a tough core material formed from a sintered core mixture of tungsten carbide powder having a grain size in the range of about five to ten microns (preferably about six microns) and cobalt powder providing in the range of about twelve to seventeen percent (preferably about fifteen to seventeen percent) of the core mixture by weight, which core material forms the majority of the base portion 12 and an inner part 20 of the tip portion 16; and a wear resistant crown material formed from a sintered crown mixture of tungsten carbide powder having a grain size of under about six microns (preferably about one and one-half microns) and cobalt powder providing in the range of about four to eleven percent (preferably nine to eleven percent) of the crown mixture by weight, which crown material forms a crown 22 covering the inner part 20 and defining the outer or cutting surface of the tip portion 16, and extends slightly along the upper end of the base portion 12 so that the crown 22 extends slightly into the socket in the drill bit 14 leaving only the crown 22 exposed for rock cutting or crushing action. The interface 23 between the core material and the crown material, as is shown in FIG. 3, is free of voids and is visually irregular along its length when cross sectioned and viewed at a magnification of about sixty-five times which helps retain the crown material on the core material.

Figure 4:
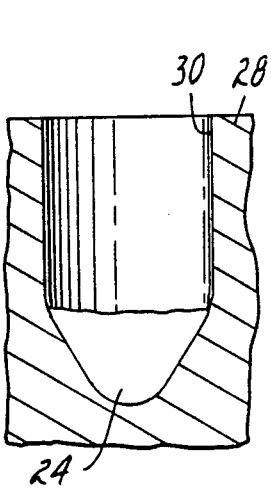
FIGS. 4 through 6 which have parts sectioned to show details, sequentially illustrate method steps used in making the cutting element shown in FIGS. 1, 2 and 3.
Figure 5:
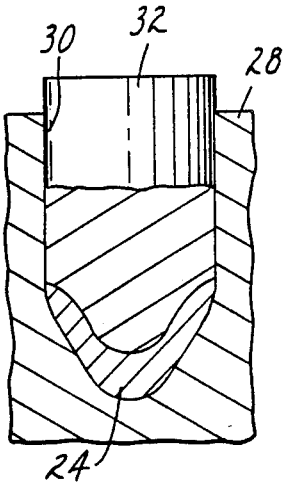
Figure 6:
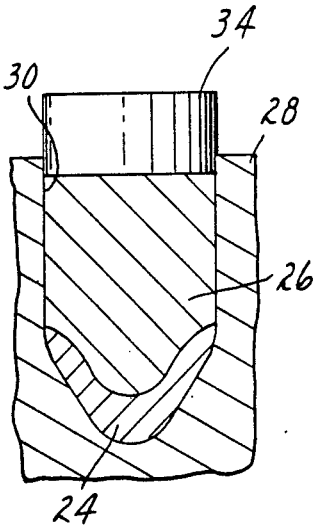
Figure 3:
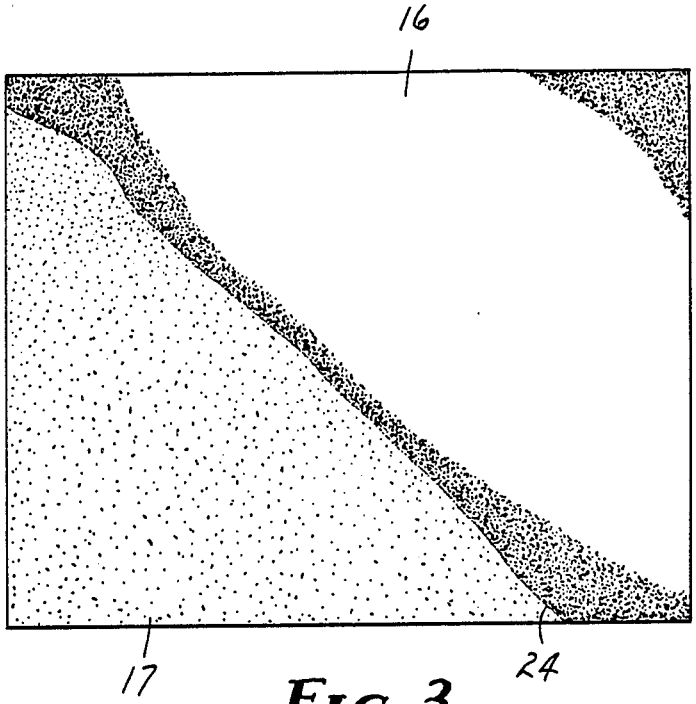
FIG. 3 is a drawing of an interface between an inner part of a tip and a crown of the cutting element of FIG. 1 magnified about sixty-five times.

Several of the steps in a novel method for forming the cutting element 10 shown in FIGS. 1 through 3 are shown schematically in FIGS. 4 through 6.

After mixing the crown mixture 24 of tungsten carbide powder having a grain size of under about six microns and cobalt powder in the range of about four to eleven percent of the crown mixture 24, and mixing a core mixture 26 of tungsten carbide powder having a grain size in the range of about five to ten microns and cobalt powder in the range of about twelve to seventeen percent of the core mixture 26; that method comprises the further steps of providing a die 28 (FIG. 4) having a cavity 30 approximately the shape of (but slightly larger than due to shrinkage during sintering) the cutting element 10 to be formed; positioning in the cavity 30 a quantity of the crown mixture 24 in the shape of the crown 22 defining the outer surface for the tip portion 16 of the cutting element 10 by inserting a punch 32 (FIG. 5) with an appropriately shaped tip and applying a force to the punch 32 that applies a pressure of less than about 600 pounds per square inch to the crown mixture 24 to retain it in the shape of the crown after the punch 32 is removed; positioning in the cavity 30 a quantity of the core mixture 26 (FIG. 6) sufficient to form almost all of the base portion 12 and the inner part 20 of the tip portion 16 of the cutting element 10; pressing the two quantities of the crown and core mixtures 24 and 26 together and into the die 28 at pressures in the range of about ten to fifteen tons per square inch as by a ram 34; removing the pressed composite of the crown and core mixtures 24 and 26 from the die 28; and sintering the pressed composite (e.g., for about sixty minutes at about fourteen hundred degrees Centigrade) to form the cutting element 10.

EXAMPLE

As an illustrative, nonlimiting example, a plurality of the cutting elements 10 were each formed by inserting in the cavity 30 of the die 28 the crown mixture 24 comprising 89 percent by weight of 1.6 micron tungsten carbide, 1 percent tantalum carbide which helps inhibit tungsten carbide grain growth and 10 percent cobalt held in a pelletized state by a paraffin wax binder (e.g., the paraffin wax being about 1 percent of the crown mixture 24 by weight but not being considered part of the crown mixture 24 for determining the percentages of the other components). This crown mixture 24 was shaped by the punch 32 to a layer along the end portion of the die 28 less than about 0.250 inch thick maximum using about 250 pounds force which was calculated to provide about 500 pounds per square inch to form the crown mixture 24. The mold was then filled with the core mixture 26 which comprised 84 percent by weight of 6.4 micron tungsten carbide mixed with 16 percent by weight of cobalt, which core mixture 26 was also held in a pelletized form by a paraffin wax binder. Both mixtures 24 and 26 were then pressed into the die 28 by the ram 34 with a pressure of twelve (12) tons per square inch at room temperature. The pressed composite was then removed from the die 28 and sintered at about 1425 degrees Centigrade for about 1 hour.

Cutting elements 10 thus made were tested for crushing strength by applying forces axially of the cutting elements, and found to withstand about 18,000 pounds load, which compared favorably to conventional cutting elements of the same shape made only from the core mixture 26 which could withstand only about 12,000 pounds loading in the same test. Comparative wear tests conducted on a single row rock cutting tester showed that the cutting elements 10 according to the present invention were worn down by about 0.027 inches compared to wear of 0.065 inches on the aforementioned conventional cutting elements made only from the core mixture 26. Also the cutting elements 10 according to the present invention together with the aforementioned conventional cutting elements made only from the core mixture 26 were inserted into a rock drill and used to drill a bore more than 3500 feet deep. The conventional cutting elements wore to an indistinct conical shape, whereas the cutting elements 10 according to the present invention generally retained their original tooth profile.

The cutting element according to the present invention and the novel method by which it is made have now been described with reference to single embodiments thereof. It will be apparent to those skilled in the art that many changes can be made in the embodiments described without departing from the scope of the present invention. For example, the crown of the cutting element may not cover its entire tip portion, but may end somewhat above the juncture between the tip portion and the base portion of the cutting element. Thus the scope of the present invention should not be limited to the structure and method specifically described in this application, but only by methods and structures described by the language of the claims and the equivalents of those methods and structures.

We claim:

1. A cutting element including a base portion adapted to be inserted in a socket in a rotary drill bit, and a tip portion adapted to project from the socket, said cutting element comprising a tough core material formed by sintering a core mixture of tungsten carbide powder and cobalt powder, which cobalt powder forms about twelve to seventeen percent of the core mixture by weight, said core material forming the majority of said base portion and an inner part of said tip portion, and a wear resistant crown material formed by sintering a crown mixture of tungsten carbide powder and cobalt powder, which cobalt powder forms about four to eleven percent of the crown mixture by weight, said crown material covering said inner part and defining at least the majority of the outer surface of said tip portion, the interface between said core material and said crown material being free of voids and being visually irregular along its length when said tip portion is cross sectioned and viewed at a magnification of about sixty-five times so that said crown material is firmly retained on said inner part during cutting of rock.

2. A cutting element according to claim 1 wherein said core mixture has a grain size in the range of about five to ten microns and said crown mixture has a grain size of under about six microns.

3. A cutting element according to claim 1 wherein said crown material has a maximum thickness of about fifty percent of the axial height of said tip portion.

4. A cutting element according to claim 1 wherein said crown material defines the entire outer surface of said tip portion.

5. A method for forming a cutting element having a base portion adapted to be inserted in a socket in a rotary drill bit and a tip portion adapted to project from the socket, said method comprising:

mixing a crown mixture of tungsten carbide powder and cobalt powder with the cobalt powder forming in the range of about four to eleven percent of the mixture by weight;

mixing a core mixture of tungsten carbide powder and cobalt powder with the cobalt powder forming in the range of about twelve to seventeen percent of the mixture;

providing a die having a cavity approximately the shape of the cutting element to be formed;

positioning in the cavity a quantity of the crown mixture in the shape of a crown defining at least a major portion of the outer surface for the tip portion of the cutting element using a pressure of less than about 600 pounds per square inch;

positioning in the cavity a quantity of the core mixture sufficient to form almost all of the base portion and at least an inner part of the tip portion of the cutting element;

pressing the two quantities of the mixtures together and into the die at pressures in the range of about ten to fifteen tons per square inch; and sintering the pressed insert to form the cutting element.

6. A cutting element made by the method of claim 5.

* * * * *